US010774591B2

(12) United States Patent
Wang et al.

(10) Patent No.: US 10,774,591 B2
(45) Date of Patent: Sep. 15, 2020

(54) DRILL-POWER-BASED DIRECTIONAL HYDRAULIC FRACTURING SYSTEM FOR DOWNHOLE QUICK SLOTTING AND METHOD THEREOF

(71) Applicant: SHANDONG UNIVERSITY OF SCIENCE AND TECHNOLOGY, Qingdao (CN)

(72) Inventors: Gang Wang, Qingdao (CN); Weimin Cheng, Qingdao (CN); Xiaohua Zhou, Qingdao (CN); Lulu Sun, Qingdao (CN); Chenghao Jiang, Qingdao (CN); Zhen Liu, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 16/616,790

(22) PCT Filed: Dec. 25, 2018

(86) PCT No.: PCT/CN2018/123635
§ 371 (c)(1),
(2) Date: Nov. 25, 2019

(87) PCT Pub. No.: WO2019/196503
PCT Pub. Date: Oct. 17, 2019

(65) Prior Publication Data

US 2020/0080382 A1 Mar. 12, 2020

(30) Foreign Application Priority Data

Apr. 12, 2018 (CN) ..... 2018 1 0323428

(51) Int. Cl.
*E21B 7/18* (2006.01)
*E21B 33/127* (2006.01)
(Continued)

(52) U.S. Cl.
CPC ..... *E21B 7/18* (2013.01); *E21B 33/127* (2013.01); *E21B 43/114* (2013.01); *E21B 43/26* (2013.01); *E21C 37/12* (2013.01)

(58) Field of Classification Search
CPC ..... E21B 7/18; E21B 33/127; E21B 43/114; E21B 43/26; E21B 10/32; E21B 33/1243;
(Continued)

(56) References Cited

U.S. PATENT DOCUMENTS 2,651,513 A * 9/1953 Ramsay ..... E21C 41/18 299/11
4,301,875 A * 11/1981 Munding ..... E21B 7/14 175/12
(Continued)

FOREIGN PATENT DOCUMENTS

CN 104131832 A 11/2014
CN 205477511 U 8/2016
(Continued)

OTHER PUBLICATIONS

Copy of the Decision to grant a patent dated Aug. 29, 2019 from corresponding application No. CN 201810323428.8.
(Continued)

*Primary Examiner* — James G Sayre
(74) *Attorney, Agent, or Firm* — Hauptman Ham, LLP

(57) ABSTRACT

Provided are a drill-power-based directional hydraulic fracturing system for downhole quick slotting and a method thereof. The directional hydraulic fracturing system includes a water injection pump, a high pressure rubber pipe arranged on the water injection pump is in communication with a drill, a dedicated sealing drill rod for hydraulic fracturing is arranged on the drill, a front segment of the drill rod may be connected with a directional borehole sealer through threads and a sealing ring is provided at the threaded connection.
(Continued)

The main steps include drilling, slotting, borehole sealing and fracturing. Firstly, a drill-cut integrated tool is installed at a front end of the drill rod. After drilling is completed, hydraulic slotting, permeability improvement and pressure relief are performed without changing a drill bit. After slotting is completed, the drill bit is retreated, and the directional borehole sealer is installed and pushed to a predetermined position for efficiency sealing. After sealing is completed, high pressure water injection fracturing is performed to increase fissure density and scope with "high pressure penetration" as main. Thus, water injection for the coal seam with high ground pressure and low porosity is realized. In this way, coal bumps are effectively prevented, the powder dust concentration is reduced and the disasters such as gas and fire are prevented.

2 Claims, 1 Drawing Sheet

(51) Int. Cl.
*E21B 43/114* (2006.01)
*E21B 43/26* (2006.01)
*E21C 37/12* (2006.01)

(58) Field of Classification Search
CPC ..... E21C 37/12; E21C 35/22; E21C 41/18; E21F 5/02
USPC ..... 166/308.1
See application file for complete search history.

(56) References Cited

U.S. PATENT DOCUMENTS

| | | | | |
|---|---|---|---|---|
| 9,291,044 | B2 * | 3/2016 | Murphy | E21B 23/01 |
| 2002/0029908 | A1 * | 3/2002 | Bloom | E21B 23/08 175/99 |
| 2005/0121196 | A1 * | 6/2005 | East, Jr. | E21B 43/26 166/308.1 |

FOREIGN PATENT DOCUMENTS

| | | | |
|---|---|---|---|
| CN | 106320985 | A | 1/2017 |
| CN | 206190278 | U | 5/2017 |
| CN | 108757000 | A | 11/2018 |

OTHER PUBLICATIONS

International Search Report issued in corresponding International Application No. PCT/CN2018/123635, dated Feb. 19, 2019, State Intellectual Property Office of the P.R. China, Beijing, China.
Written Opinion issued in corresponding International Application No. PCT/CN2018/123635, dated Feb. 19, 2019, State Intellectual Property Office of the P.R. China, Beijing, China.
Chinese Search Report issued in corresponding Chinese Patent Application No. 201810323428.8, dated Feb. 25, 2019.
Chinese Search Report (Added to retrieve) in corresponding Chinese Patent Application No. 201810323428.8, dated May 22, 2019.
First Office Action issued in corresponding Chinese Patent Application No. 201810323428.8, dated Mar. 19, 2019.
Second Office Action issued in corresponding Chinese Patent Application No. 201810323428.8, dated May 30, 2019.

* cited by examiner

DRILL-POWER-BASED DIRECTIONAL HYDRAULIC FRACTURING SYSTEM FOR DOWNHOLE QUICK SLOTTING AND METHOD THEREOF

RELATED APPLICATIONS

The present application is a National Phase of International Application Number PCT/CN2018/123635, filed Dec. 25, 2018, and claims the priority of Chinese Application No. 201810323428.8, filed Apr. 12, 2018.

TECHNICAL FIELD

The present disclosure relates to the field of disaster prevention and control of coal mining work face, and in particular to a drill-power-based directional hydraulic fracturing system for downhole quick slotting and a method thereof.

BACKGROUND

Practices at home and abroad demonstrate that coal seam water injection is an effective method of actively lowering impact tendency of work face coal seam and reducing generation of powder dusts. According to the method, high pressure water is pre-injected into a coal mass so that the coal rock mass expands its original fissure, generates new fissures, destroys the entirety of the coal rock mass, lowers its strength and releases pressure of the coal mass by use of fracturing, washing and wedging actions of the pressurized water on a weak face and physical and chemical actions of water on the coal mass. In this way, the occurrences of coal bumps are effectively avoided. The water injected into the coal mass is penetrated toward a coal block divided by the coal fissure along the fissure and stored in the fissures and pores to increase moisture of the coal mass and wet raw coal dusts in the coal mass, thereby disabling the dusts to fly and reduce an ability to generate floating dusts during coal mining.

Since a long time ago, the cognition of people for water injection in coal seam always stays in a qualitative cognition stage. However, in a traditional water injection manner, a borehole is directly sealed before water injection. This water injection manner features less water injection amount of single borehole, complex borehole sealing technique, and poor penetration effect of water in the coal seam. Thus, the water injection in the coal seam is affected. A size of a coal seam porosity is an important index representing water injection difficulty. Coal seam fissure and pore development degree are the first factors affecting the difficulty of coal seam water injection. However, because different mines enter a deep mining stage one by another in China, prominent problems of high initial stress of coal rock, undeveloped fissures and pores, low permeability, and high gas content and so on hold back the development of coal seam water injection technology. The coal seams of many mines in China are coal seams with high ground pressure and low porosity, joint fissures of coal seams are undeveloped and hard, water is difficult to inject into coal seams, and therefore a desired disaster prevention and control effect cannot be achieved. Further along with increase of mining depths of the coal mines in China, the problem of difficulty of water injection is further highlighted, which severely restricts the application of the coal seam water injection technology in deep high ground pressure coal seams of China, and hinders its prevention and control effect on the hazards of coal bumps and high concentration powder dusts. Therefore, the prior art is to be further improved and developed.

SUMMARY

In view of the above shortcomings of the prior art, the present disclosure provides a drill-power-based directional hydraulic fracturing system for downhole quick slotting and a method thereof. According to the system and the method, the entire hydraulic fracturing system is utilized to realize directional hydraulic fracturing of downhole coal seam.

To solve the above technical problems, the following solution of the present disclosure is adopted.

There is provided a drill-power-based directional hydraulic fracturing system for downhole quick slotting. The system includes a drill and a water injection pump. The water injection pump and the drill are connected with a high pressure rubber pipe. The drill is disposed with a dedicated sealing drill rob. A drill-cut integrated tool is disposed at a front end of the drill. Three gas-water outlets with hole diameters of 6 mm-8 mm are designed on a three-wing drill bit and a reaming drill bit of the drill-cut integrated tool. After drilling is completed, hydraulic slotting may be directly performed without retreating the drill bit. A direction borehole sealer may be disposed on the drill rod. The directional borehole sealer includes an outer shell and the outer shell is internally provided with a communicating pipe. A lower straight-through opening of the communicating pipe is connected with a transition pipe and an upper straight-through opening of the communicating pipe is in communication with a water inlet pipe. The communicating pipe between the upper straight-through opening and the lower straight-through opening is provided with a side-through water inlet. The side-through water inlet is provided with a side through opening. The outer shell is provided with a borehole sealing capsule, and a sealing ring is provided on both sides of the borehole sealing capsule respectively. A plurality of through holes are uniformly distributed on the outer shell inside the borehole sealing capsule. The transition pipes between two adjacent directional borehole sealers are connected with a water pipe connector. The directional borehole sealer and the drill rod are arranged in the borehole. The drill rod is a dedicated sealing drill rod for hydraulic fracturing. The drill rod is provided with a sealing ring so that high pressure water enters the directional borehole sealer through the drill rod.

In the drill-power-based directional hydraulic fracturing system for downhole quick slotting, the drill-cut integrated tool includes a reaming drill bit and a three-wing drill bit is provided at a front end of the reaming drill bit. Gas-water outlets are provided on the three wing drill bit and the reaming drill bit behind the three wing drill bit.

In the drill-power-based directional hydraulic fracturing method for downhole quick slotting, the implementation steps include drilling, slotting, borehole sealing, and fracturing, which can be performed in the following manner.

A. A drill-cut integrated tool is installed at a front segment of a drill rod to perform drilling by starting the drill. During the drilling, the gas-water outlets on the three wing drill bit and the reaming drill bit act to discharge slags. After the hydraulic cut drilling reaches a predetermined position, the water injection pump is started and switched to high pressure water. The drill remains in a rotation state, and the coal mass is cut with the hydraulic power in the borehole to form a hydraulic slot. After slotting requirements are satisfied, rotation and high pressure water are both stopped and the drill rod is pulled out slowly.

B. The drill-cut integrated tool is disassembled and the directional borehole sealer is assembled. The threaded connection of the drill rod and the directional borehole sealer is well sealed. The drill is started to push the directional borehole sealer to a predetermined position. The water injection pressure is set to less than 5 MPa. The pressurized water supplied by the water injection pump is transported to the drill through a high pressure rubber pipe so that the pressurized water enters the drill rod and further enters the directional borehole sealer. Low pressure water enters the interior of the borehole sealing capsule through the water inlet pipe of the directional borehole sealer. The lower straight-through opening serves as a water inlet and the upper straight-through opening serves as a water outlet. Water is injected into the borehole sealing capsule through the side-through opening. The outer shell has a through hole connected with the borehole sealing capsule. Both ends of an outer wall of the outer shell are provided with a sealing ring for fixing the borehole sealing capsule respectively. When the borehole sealing capsule is filled up with water, the borehole sealing capsule has a diameter of greater than 94 mm and thus can effectively seal the borehole. When the water injection pressure exceeds 5 MPa, a pressure control valve on the directional borehole sealer will open to allow high pressure water to enter the borehole.

C. After the borehole sealing is completed, hydraulic fracturing is performed. The water injection pressure is slowly increased to 30 MPa while change of a pressure gauge is observed. The high pressure water injection is performed for about 10 minutes. The first stage of fracturing work is completed. After the water injection pump is shut down and the pressure is released, the directional borehole sealer restores to a normal size.

D. The drill is adjusted to pump the directional borehole sealer to the second stage of fracturing work. The second stage of the fracturing work is performed by repeating steps B and C and so on until the fracturing work is completed.

The present disclosure provides a drill-power-based directional hydraulic fracturing system for downhole quick slotting and a method thereof. According to the method, the steps include drilling, slotting, borehole sealing and fracturing. Firstly, the drill-cut integrated tool is installed at the front end of the drill rod. After drilling is completed, hydraulic slotting, permeability improvement and pressure relief are performed without changing the drill bit. After the slotting is completed, the drill bit is retreated. Then, the directional borehole sealer is installed and pushed to the predetermined position to perform efficient sealing. After borehole sealing is completed, high pressure water injection is performed for fracturing so that a fissure density and a scope are increased with "high pressure penetration" as main. Thus, water injection for the coal seam with high ground pressure and low porosity is realized. In this way, coal bumps are effectively prevented, the powder dust concentration is reduced and the disasters such as gas and fire are prevented. In this case, the directional slotting and hydraulic fracturing can be performed for the coal seam accurately and quickly. With the drill-cut integrated drill bit, the coal seam can be drilled quickly. Further, in-borehole hydraulic slotting is performed by use of the hydraulic cutting technology. This process may be continuously completed without disassembling the drill bit, saving time and labor, and lowering labor intensity. The borehole high pressure water is sealed by the directional borehole sealer. The directional borehole sealer can perform directional fracturing for a borehole slotting position. The directional borehole sealer may be recycled with a sealing effect equal to or higher than 30 MPa. The entire fracturing system features simple arrangement, easy operation and high safety and therefore can be applied to different working environments so that the directional hydraulic fracturing is realized for a floor and a roadway side. Compared with traditional hydraulic fracturing technology of coal seam, the technology of the present disclosure saves tedious site processes. In this case, the technology is simpler and more convenient, reducing the borehole sealing time. The directional borehole sealer may be recycled with low cost of single sealing and good sealing effect.

Numerals of drawings are described as follows: 1—water inlet pipe, 2—sealing ring, 3—borehole sealing capsule, 4—side through water inlet, 5—side through opening, 6—water pipe connector, 7—upper straight through opening, 8—through hole, 9—outer shell, 10—low straight through hole, 11—water injection pump, 12—high pressure rubber pipe, 13—drill, 14—borehole, 15—drill rod, 16—hydraulic slot, 17—directional borehole sealer, 18—coal mass, 19—reaming drill bit, 20—gas-water outlet, 21—three wing drill bit.

DETAILED DESCRIPTION OF THE EMBODIMENTS

The present disclosure provides a drill-power-based directional hydraulic fracturing system for downhole quick slotting and a method thereof. To make the object, technical solutions and effects of the present disclosure clearer, the present disclosure will be detailed below further. It is understood that the specific examples described herein are merely used for explaining the present disclosure rather than limiting the present disclosure.

Figure 1:
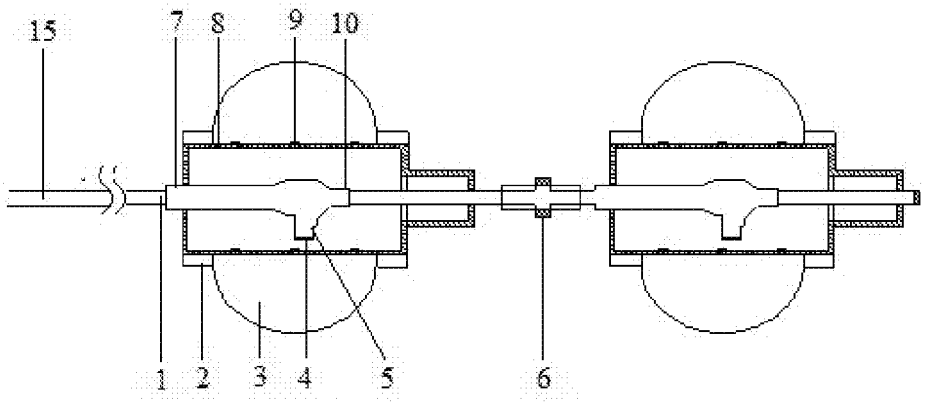
FIG. 1 is a schematic diagram illustrating a structure of a directional borehole sealer according to an example of the present disclosure.
Figure 2:
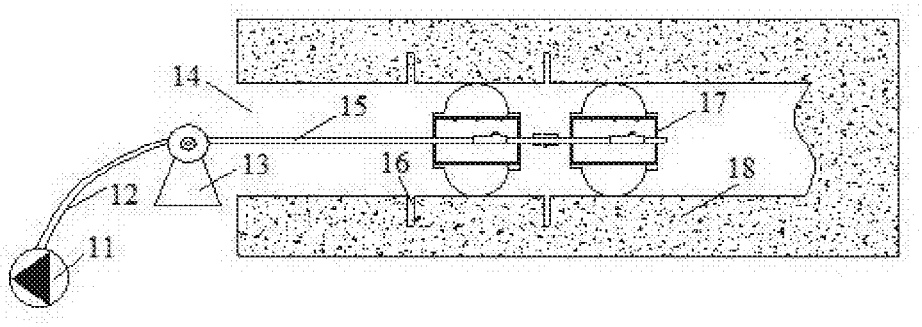
FIG. 2 is a schematic diagram illustrating a structure of a hydraulic fracturing system according to an example of the present disclosure.
Figure 3:
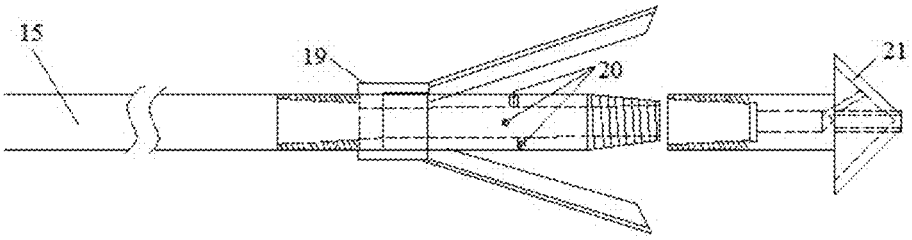
FIG. 3 is a schematic diagram illustrating a structure of a drill-cut integrated tool according to an example of the present disclosure.

The present disclosure provides a drill-power-based directional hydraulic fracturing system for downhole quick slotting. As shown in FIG. 2, the system includes a drill 13. A dedicated hollow sealing drill rod 15 is arranged on the drill 13. A drill-cut integrated tool is arranged on a front end of the drill rod 15. Further, the drill rod 15 is further provided with a directional borehole sealer 17. The directional borehole sealer 17 is arranged in a borehole 14 together with the drill rod 15. A high pressure rubber pipe 12 is in communication with a water injection pump 11 to supply corresponding pressurized water. The above drill-cut integrated tool includes a reaming drill bit 19. A three wing drill bit 21 is provided on a front end of the reaming drill bit 19. Gas-water outlets 20 are provided on the three wing drill bit 21 and the reaming drill bit 19 behind the three wing drill bit 21. As shown in FIG. 1, the above directional borehole sealer includes an outer shell 9. The outer shell is internally provided with a communicating pipe. A lower straight-through opening 10 of the communicating pipe is in communication with a transition pipe and an upper straight-through opening 7 of the communicating pipe is in communication with a water inlet pipe 1. The communicating pipe between the upper straight-through opening 7 and the lower straight-through opening 10 is provided with a side-through water inlet 4. The side-through water inlet 4 is provided with a side through opening 5. The outer shell 9 is provided with a borehole sealing capsule 3, and a sealing ring 2 is provided on both sides of the borehole sealing capsule 3 respectively. A plurality of through holes are uniformly distributed on the outer shell 9 inside the borehole sealing capsule 3. The transition pipes between two adjacent directional borehole sealers are connected with a water pipe connector 6.

The present disclosure further provides a drill-power-based directional hydraulic fracturing method for downhole quick slotting, which mainly includes steps of drilling, slotting, borehole sealing and fracturing. The method include the following steps.

At step A, A drill-cut integrated tool is installed at a front segment of a drill rod 15 to perform drilling by starting the drill. During the drilling, the gas-water outlets 20 on the three wing drill bit and the reaming drill bit act to discharge slags. After the hydraulic cut drilling reaches a predetermined position, the water injection pump 11 is started and switched to high pressure water. The drill 13 remains in a rotation state, and the coal mass is cut with the hydraulic power in the borehole to form a hydraulic slot 16. After slotting requirements are satisfied, rotation and high pressure water are both stopped and the drill rod 15 is pulled out slowly.

At step B, The pressurized water supplied by the water injection pump 11 is transported to the drill 13 through a high pressure rubber pipe 12 so that the pressurized water enters the drill rod 15. The threaded connection of the drill rod 15 and the directional borehole sealer 17 is well sealed. Low pressure water enters the water inlet pipe 1 of the directional borehole sealer 17 through the drill rod 15 and flows into the interior of the borehole sealing capsule 3. The lower straight-through opening 10 serves as a water inlet and the upper straight-through opening 7 serves as a water outlet. Water is injected into the borehole sealing capsule 3 through the side-through opening 6. The outer shell 9 has a through hole connected with the borehole sealing capsule 3. Both ends of an outer wall of the outer shell 9 are provided with a sealing ring for fixing the borehole sealing capsule 3 respectively. When the borehole sealing capsule 3 is filled up with water, the borehole sealing capsule 3 has a diameter of greater than 94 mm and thus can effectively seal the borehole 14. When the water injection pressure exceeds 5 MPa, a pressure control valve on the directional borehole sealer 17 will open to allow high pressure water to enter the borehole 4.

At step C, after step B is completed, hydraulic fracturing is performed. The water injection pressure is slowly increased to 30 MPa while change of a pressure gauge is observed. The water injection is performed for about 10 minutes to complete the first stage of fracturing work. After the water injection pump 11 is shut down and the pressure is released, the directional borehole sealer 17 restores to a normal size.

At step D, The drill 13 is adjusted to pump the directional borehole sealer 17 to the second stage of fracturing work. The second stage of the fracturing work is performed by repeating steps B and C and so on until the fracturing work is completed.

To further describe the present disclosure, descriptions are made below with more detailed examples. The hydraulic fracturing of a coal seam of a roadway side of a mine is taken as example.

At step 1, drilling and slotting

A specially-made drill bit 21 is added before a drilling tool. Three gas-water outlets 20 with hole diameters of 6 mm-8 mm on the drill bit. At the same time, three gas-water outlets 20 are arranged on the reaming drill bit 19. During drilling, the gas-water outlets 20 on the three-wing drill bit 21 and the reaming drill bit 19 act to discharge slags. When the drilling reaches a predetermined position, switching is performed to high pressure water to perform in-borehole hydraulic cutting.

The drill 13 and the drilling tool are installed. After the hydraulic cut drilling reaches a predetermined position, the water injection pump is started and performs corresponding switching. The drill 13 remains in a rotation state for hydraulic cutting. After slotting requirements are satisfied, rotation and high pressure water are both stopped and the drill rod is pulled out slowly. According to the site work, the borehole 14 has a diameter of 94 mm and a hole depth of 40 m and the hydraulic slot 16 has a radius of 0.5 m.

At step 2, the directional borehole sealer performs borehole sealing based on drill power.

Based on the traditional borehole sealing technique, a directional borehole sealer is adopted to perform directional sealing of multi-segment fracturing of long borehole. In this way, pressurized sealing of a middle segment of the borehole is realized to seal a big fissure of the middle segment of the borehole, thereby improving the sealing effect. A pressurized borehole sealing apparatus mainly includes a water injection pump, a high pressure rubber pipe, a drill, a drill rod, and a directional borehole sealer.

The pressurized water supplied by the water injection pump 11 is transported to the drill 13 through a high pressure rubber pipe 12 so that the pressurized water enters the drill rod 15. The threaded connection of the drill rod 15 and the directional borehole sealer 17 is well sealed. Low pressure water enters the water inlet pipe 1 of the directional borehole sealer 17 through the drill rod 15 and flows into the interior of the borehole sealing capsule 3. The outer shell 9 provides support and protection for the borehole sealing capsule 3 to prevent the borehole sealing capsule 3 from being damaged due to deformation occurring at the time of assembly and deep drilling. The lower straight-through opening 10 serves as a water inlet and the upper straight-through opening 7 serves as a water outlet. Water is injected into the borehole sealing capsule 3 through the side-through opening 6. The outer shell 9 has a through hole connected with the borehole sealing capsule 3. Both ends of an outer wall of the outer shell 9 are provided with a sealing ring for fixing the borehole sealing capsule 3 respectively. When the borehole sealing capsule 3 is filled up with water, the borehole sealing capsule 3 has a diameter of greater than 94 mm and thus can effectively seal the borehole. When the water injection pressure exceeds 5 MPa, a pressure control valve on the directional borehole sealer 17 will open to allow high pressure water to enter the borehole 14.

At step 3, high pressure hydraulic fracturing is performed.

After step 2 is completed, hydraulic fracturing is performed. Water injection pressure is slowly increased to 30 MPa, and water injection is continuously performed for about 10 minutes so that the first stage of fracturing work is completed. After the water injection pump 11 is shut down for pressure relief, the directional borehole sealer 17 restores to a normal size.

At step 4, cyclic work

The drill 13 is adjusted to pump the directional borehole sealer 17 to the second stage of fracturing work. The second stage of the fracturing work is performed by repeating steps B and C and so on until the fracturing work is completed.

Of course, the above descriptions are merely preferred examples of the present disclosure which do not limit the present disclosure. It is noted that all equivalent substitutions and noticeable variations made by persons of skill in the prior art under the teaching of the present disclosure shall fall within the scope of protection of the present disclosure and therefore shall be protected by the present disclosure.

The invention claimed is:

1. A drill-power-based directional hydraulic fracturing method for downhole quick slotting, comprising a drill-power-based directional hydraulic fracturing system for downhole quick slotting, comprising a drill, wherein a water injection pump and a drill are connected with a high pressure rubber pipe and a dedicated sealing drill rod is arranged on the drill; a drill-cut integrated tool is arranged at a front end of the drill rod; three gas-water outlets with hole diameters of 6 mm-8 mm are designed on a three-wing drill bit and a reaming drill bit of the drill-cut integrated tool; after drilling is completed, hydraulic slotting is performed directly without retreating the drill bit; a plurality of directional borehole sealers are arranged on the drill rod, the directional borehole sealer comprises an outer shell which is internally provided with a communicating pipe, a lower straight-through opening of the communicating pipe is in communication with a transition pipe, an upper straight-through opening of the communicating pipe is in communication with a water inlet pipe, the communicating pipe between the upper straight-through opening and the lower straight-through opening is provided with a side-through water inlet respectively, and the side-through water inlet is provided with a side through opening; a borehole sealing capsule is provided on the outer shell, a sealing ring is provided on both sides of the borehole sealing capsule respectively, and a plurality of through holes are arranged uniformly on the outer shell in the borehole sealing capsule, and transition pipes between two adjacent directional borehole sealers are connected with a water pipe connector; the directional borehole sealer and the drill rod are arranged in the borehole; the drill rod is a dedicated sealing drill rod for hydraulic fracturing and is provided with a sealing ring so that high pressure water enters the directional borehole sealer through the drill rod, wherein the method is performed according to the steps of drilling—slotting—borehole sealing—fracturing as follows:

A. a drill-cut integrated tool is installed at a front segment of the drill rod to perform drilling by starting the drill; during the drilling, the gas-water outlets on the three-wing drill bit and the reaming drill bit act to discharge slags; after the hydraulic cut drilling reaches a predetermined position, the water injection pump is started and switched to high pressure water; the drill remains in a rotation state, and a coal mass is cut with the hydraulic power in the borehole to form a hydraulic slot; after slotting requirements are satisfied, rotation and high pressure water are both stopped and the drill rod is pulled out slowly;

B. the drill-cut integrated tool is disassembled and the directional borehole sealer is assembled; the threaded connection of the drill rod and the directional borehole sealer is well sealed; the drill is started to push the directional borehole sealer to a predetermined position; the water injection pressure is set to less than 5 MPa; the pressurized water supplied by the water injection pump is transported to the drill through a high pressure rubber pipe so that the pressurized water enters the drill rod and further enters the directional borehole sealer; low pressure water enters the interior of the borehole sealing capsule through the water inlet pipe of the directional borehole sealer; the lower straight-through opening serves as a water inlet and the upper straight-through opening serves as a water outlet; water is injected into the borehole sealing capsule through the side-through opening; the outer shell has a through hole connected with the borehole sealing capsule; both ends of an outer wall of the outer shell are provided with a sealing ring for fixing the borehole sealing capsule respectively; when the borehole sealing capsule is filled up with water, the borehole sealing capsule has a diameter of greater than 94 mm and thus effectively seals the borehole; when the water injection pressure exceeds 5 MPa, a pressure control valve on the directional borehole sealer will open to allow high pressure water to enter the borehole;

C. after the borehole sealing is completed, hydraulic fracturing is performed; the water injection pressure is slowly increased to 30 MPa while change of a pressure gauge is observed; the high pressure water injection is performed for 10 minutes; the first stage of fracturing work is completed; after the water injection pump is shut down and the pressure is released, the directional borehole sealer restores to a normal size;

D. the drill is adjusted to pump the directional borehole sealer to the second stage of fracturing work; the second stage of the fracturing work is performed by repeating steps B and C and so on until the fracturing work is completed.

2. The drill-power-based directional hydraulic fracturing method for downhole quick slotting according to claim 1, wherein the above drill-cut integrated tool comprises a reaming drill bit, a three-wing drill bit is provided at a front end of the reaming drill bit, and gas-water outlets are provided on the three-wing drill bit and the reaming drill bit behind the three-wing drill bit.

* * * * *